US005538448A

United States Patent [19]

Tsao

[11] Patent Number: 5,538,448

[45] Date of Patent: Jul. 23, 1996

[54] GANG MODULAR JACK

[76] Inventor: Jenn Tsao, #29, Alley 6, Lane 87, Fu Te Street, Yang Mei Town, Tao-Yuan, Taiwan

[21] Appl. No.: 119,910

[22] Filed: Sep. 10, 1993

[51] Int. Cl.[6] ..... H01R 4/02

[52] U.S. Cl. ..... 439/874; 439/676; 439/83

[58] Field of Search ..... 439/741, 751, 439/80–83, 874, 876, 676

[56] References Cited

U.S. PATENT DOCUMENTS

| | | | |
|---|---|---|---|
| 4,638,406 | 1/1987 | Samson | 439/83 |
| 4,808,113 | 2/1989 | Kanesige et al. | 439/83 |
| 5,076,796 | 12/1991 | Kusayanagi et al. | 439/83 |
| 5,249,987 | 10/1993 | Kristiansen | 439/676 |
| 5,277,625 | 1/1994 | Iannella et al. | 439/620 |
| 5,356,299 | 10/1994 | Kumishi et al. | 439/83 |

FOREIGN PATENT DOCUMENTS

0486845A2 5/1992 European Pat. Off. .

*Primary Examiner*—David L. Pirlot
*Attorney, Agent, or Firm*—Woodcock Washburn Kurtz Mackiewicz & Norris

[57] ABSTRACT

Configurations of modular jacks adapted to be mounted on a printed circuit having a plurality of recesses located close to terminal slots at both sides to rectify dimensional variation caused by plastic shrinkage, having terminal slots constructed by two V-shape protrusions at their neck area so that the round terminal part is more precisely positioned in the housing, having a flux trap provided at a contact area between the plastic housing and a contact pin to eliminate the wicking of the flux, and having a socket.

15 Claims, 3 Drawing Sheets

GANG MODULAR JACK

FIELD OF THE INVENTION

The present invention generally relates to electrical connectors, and more particularly to improved configurations of modular jacks which are used for connecting a telephone set to a telephone line.

BACKGROUND OF THE INVENTION

Conventionally, modular jacks having fundamental parts thereof standardized in conformance with the FCC standard or the like are used to connect telephone sets to telephone lines. The modular jack of this kind generally has a box-shaped housing with a plug inserting opening on the front surface of the housing. When the telephone set is connected to the telephone line, a plug which is provided on an end of the telephone line is inserted into the plug inserting opening. A plurality of contact pins are held in the housing so that one end of each of the contact pins projects from the bottom of the housing to constitute a terminal part and the other end of each of the contact pins projects within the plug inserting opening of the housing to constitute a contact part. The modular jack is placed on a printed circuit board which is secured to a main telephone body, in such a manner that the plug inserting opening is exposed to the outside of the telephone body. The terminal part constituted by the contact pins projecting from the bottom of the housing is soldered to respective circuit patterns on the printed circuit board within the telephone body.

Because of the dimensional variation of the jack caused by plastic shrinkage, the resultant position of the terminal part of a conventional modular jack is somewhat different from the nominal position as designed. For this reason, it is difficult and time-consuming to solder the terminal part of the modular jack to the printed circuit board. In addition, owing to the wicking strength induced in the contact area between the plastic housing and the contact pin, the flux migrates up along the contact pin to the contact part during fluxing and soldering processes so that the conductivity of the contact part is lowered. Furthermore, since sockets of conventional telephone sets are separate from the modular jacks where the sockets may be used as a DC power socket, antenna socket or an interface socket for another device, it is time-consuming to assemble the sockets and the modular jacks onto the telephone sets. Consequently, there is a need for practical and economical configurations of modular jacks which can overcome the disadvantages described above.

SUMMARY OF THE INVENTION

Accordingly, it is the general object of the present invention to provide a novel and useful configurations of modular jacks in which the problems described heretofore are eliminated.

A specific object of the present invention is to provide an electrical connection in which the terminal part of a contact pin is more precisely positioned.

According to a first aspect of the present invention, a plurality of recesses are located close to terminal slots at both sides to rectify dimensional variation caused by plastic shrinkage.

According to a further aspect of this invention, a terminal slot is constructed by two V-shape protrusions at its neck area so that the round terminal part of the contact pin is more precisely positioned in the housing.

Another specific object of the present invention is to eliminate the wicking of the flux.

According to a second aspect of the invention, a flux trap is provided at the contact area between the plastic housing to eliminate the wicking of the flux.

According to a third aspect of the present invention, a modular jack is integrated with a socket.

These and other objects, advantages and features of the present invention will be more fully understood and appreciated by reference to the following detailed description when read in conjunction with the: accompanying drawings.

DETAILED DESCRIPTION OF THE PREFERRED EMBODIMENTS

Figure 1:
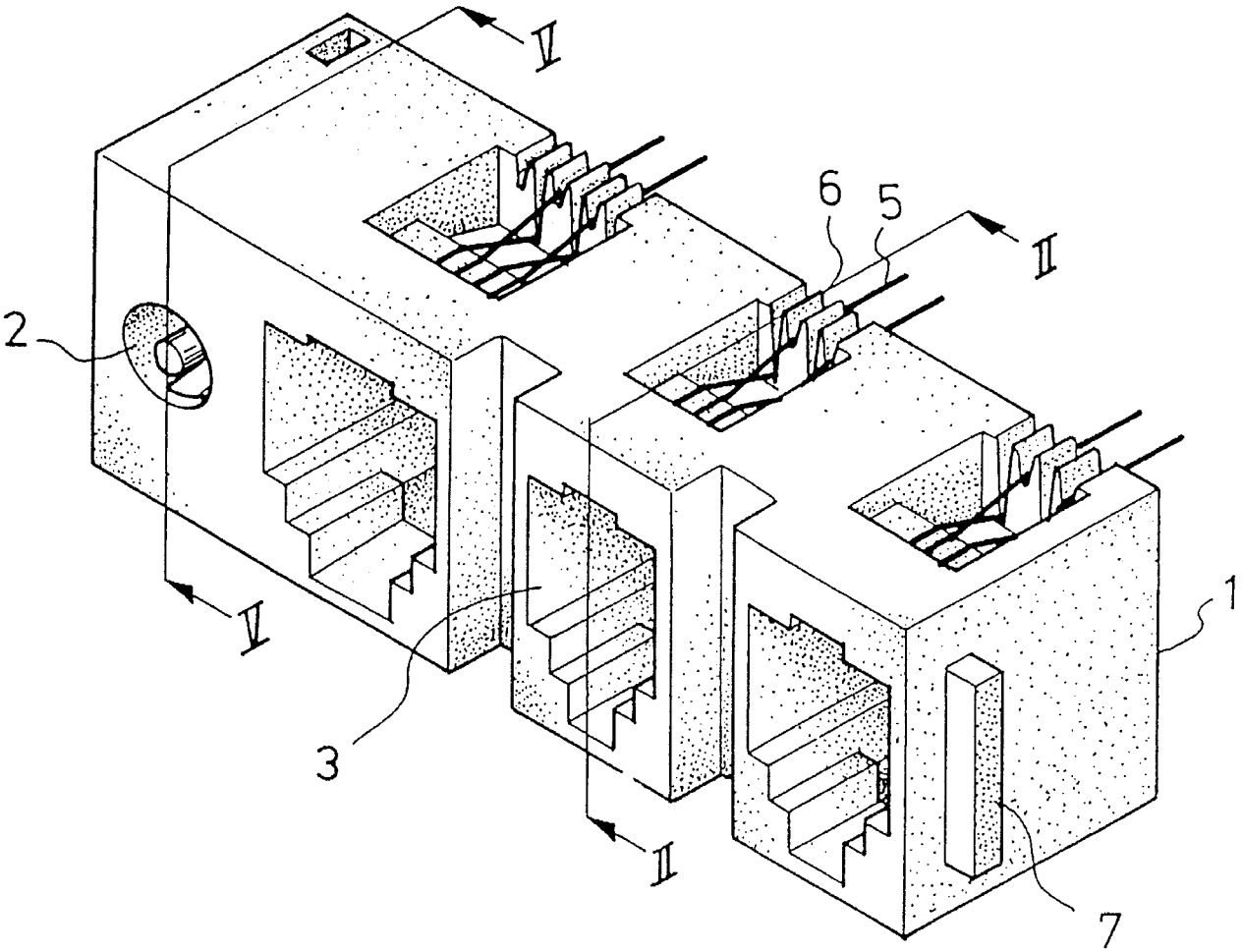
FIG. 1 is a perspective view showing an embodiment of a modular jack in accordance with the present invention.

FIG. 1 depicts an embodiment of a modular jack in accordance with the present invention. A preferred embodiment of a modular jack of the present invention mainly comprises a housing 1, a socket 2, at least one plug inserting opening 3, two mounting legs 4 (FIG. 2), and two mounting ears 7. The housing 1 in the preferred embodiment is made of formed plastics and is provided with a plug inserting opening 3 on the front surface thereof to receive a plug provided at the one end of a telephone line. A plurality of slots 6 are formed on the upper surface and the bottom surface of the housing 1. These slots 6 are disposed in parallel relationship to each other for accommodating contact pins 5.

Figure 2:
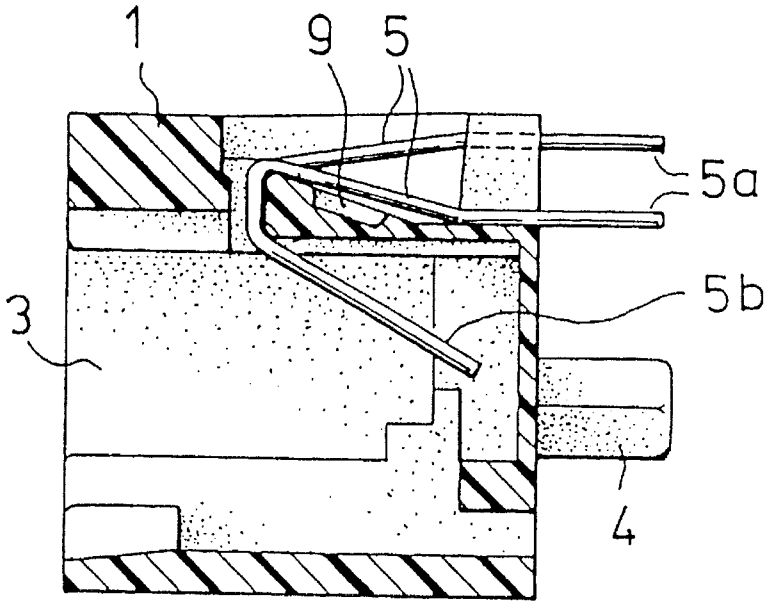
FIG. 2 is a cross section of the modular jack shown in FIG. 1 along a line II—II.

FIG. 2 is a cross section of the modular jack along a line II—II in FIG. 1, showing the structure of the plug inserting opening 3 and the contact pins 5. The modular jack is provided with several contact pins 5, each of which runs within a channel in the housing 1. Each contact pin 5 is held firmly within the channel and the slot 6. One end of a contact pin 5 projects from the bottom of the housing 1 to constitute a terminal part **5*a* for electrically conducting with a printed circuit board and the other end of a contact pin 5 projects within the plug inserting opening 3 of the housing 1 to constitute a contact part 5*b* for electrically conducting with the plug provided at one end of the telephone line. When the modular jack is mounted onto the printed circuit board by soldering, the flux, owing to the wicking strength induced in the contact area between the plastic housing and the contact pin, migrates up along the contact pin 5 to the contact part 5*b* during fluxing and soldering processes so as to lower the conductivity of the contact part 5*b***.

According to an embodiment of a modular jack of the present invention, the a cavity 9 is defined in the contact area between the plastic housing and the contact pin to function as a flux trap. The cohesion force of the wicked flux will be eliminated when the wicked flux migrates up to the cavity 9. Therefore, the problem of flux wicking is overcome, and the conductivity of this embodiment of the modular jack in accordance the present invention is much improved.

Figure 3:
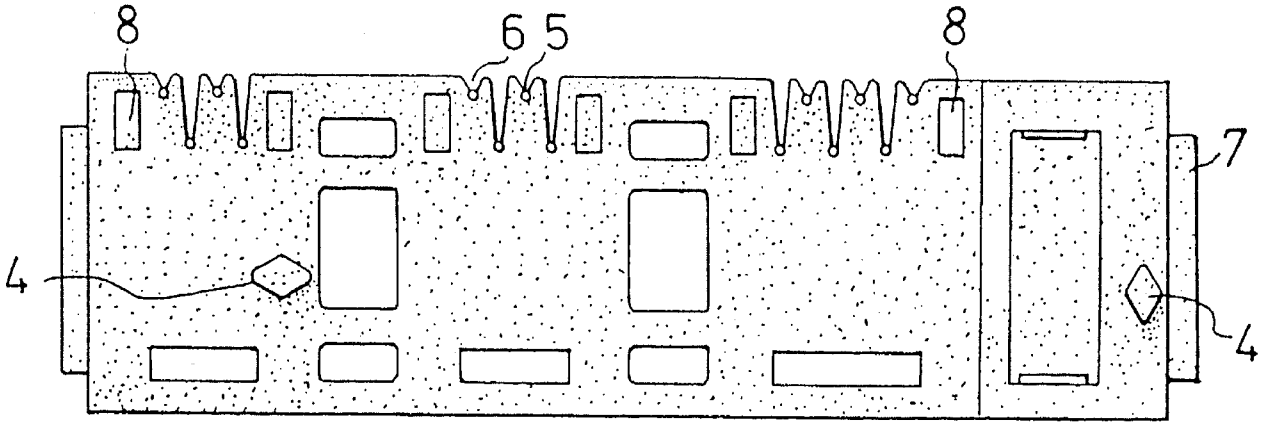
FIG. 3 is a bottom view of the modular jack of the present invention.
Figure 4:
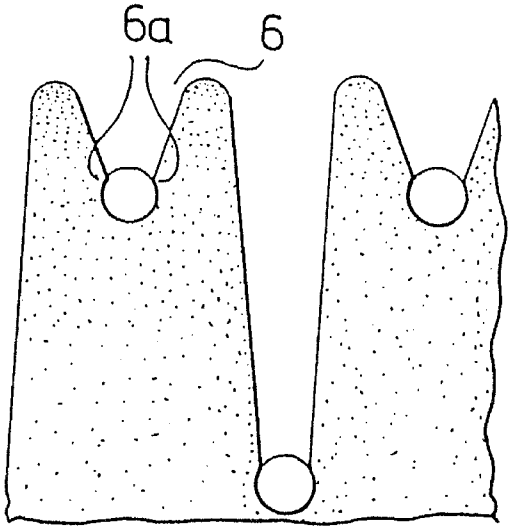
FIG. 4 is an enlarged view of a terminal slot shown in FIG. 3.

Referring to FIGS. 3 and 4, in an embodiment of a modular jack of the present invention, the housing 1 is provided with two diamond shaped mounting legs 4 at the bottom and two mounting ears 7 at the side walls. These diamond shaped mounting legs 4 are oriented so that the major axis of the first leg is oriented perpendicular to the axis of the second leg and these legs are adapted to be inserted into corresponding holes in the printed circuit board. The mounting ears 7 engage with the corresponding slits in the telephone set when the modular jack is secured to the telephone.

According to an embodiment of a modular jack of the present invention, a plurality of recesses 8 are located close to terminal slots 6 at both sides to rectify dimensional variation caused by plastic shrinkage. The terminal slots 6 with the rectifying recesses 8 result in more precise positioning of the terminal part 5*a* of the contact pins 5 than the conventional art. The resultant position of the terminal part 5*a* of the contact pins 5 is closer to the nominal position as designed. As a consequence, the modular jack can be more easily and precisely mounted onto and soldered to the printed circuit board.

According to an embodiment of a modular jack of the present invention, terminal slots 6 are constructed by two V-shape protrusions 6*a* at their neck area so that the round terminal part 5*a* of a contact pin 5 is more precisely positioned in the housing 1. The unique two V-shape protrusions 6*a* along with the rectifying recesses 8 also result in more precise positioning of the terminal part 5*a* of contact pins 5 than the conventional art.

Figure 5:
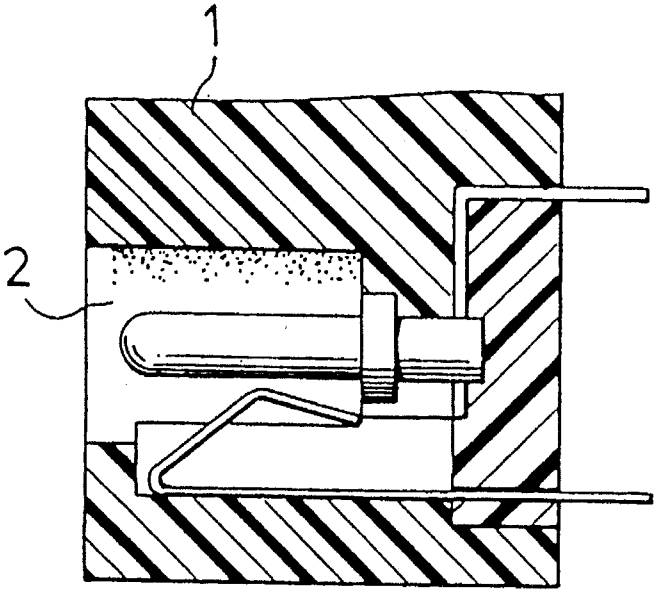
FIG. 5 is a cross section of the modular jack shown in FIG. 1 along a line V—V.

As shown in FIG. 1, an embodiment of a modular jack in accordance with the present invention is integrated with a socket 2. The socket may be configured to be suitable for a number of different functions, for example, as a DC power socket, antenna socket or interface socket for another device. In an embodiment of a modular jack in accordance with the present invention, the socket is configured for use as a DC power socket. FIG. 5 is a cross section of the modular jack along a line V—V in FIG. 1, showing this configuration of socket 2, i.e., as a DC power socket in accordance with the present invention. With the integrated socket 2, a telephone set can be assembled faster.

While only particular embodiments of the present invention have been shown and described herein, it will be appreciated that modifications thereof may be readily made thereto by those skilled in the .art. We, therefore, intend by the appended claims to cover the modifications which fall within the true spirit and scope of the invention.

What is claimed is:

1. An electrical connector adapted to be mounted on a printed circuit board, comprising:

an insulative housing having upper, front, and bottom surfaces;

at least one plug inserting opening on said front surface of said housing for inserting a plug;

a plurality of electrically conductive contact pins each of which is held in one of a plurality of terminal slots provided in said bottom surface of said housing, a first contact part extending from the one of the plurality of terminal slots, and a second contact part projecting within said plug inserting opening, the housing, plug inserting opening and plurality of electrically conductive contact pins configured so that flux can wick from a first contact to a second contact of one of the plurality of contact pins when the first contact is soldered to the printed circuit board; and an area defining a cavity in said housing provided in a contact area between said housing and said contact pin wherein said cavity functions as a flux trap which prevents flux from wicking from a first contact to a second contact of one of the plurality of contact pins when the first contact is soldered to the printed circuit board.

2. An electrical connector according to claim 1, wherein said area defining a cavity is provided between a channel and a terminal slot for said contact pin.

3. An electrical connector according to claim 1, further comprising:

a plurality of rectifying recesses located adjacent to said terminal slots to rectify plastic shrinkage.

4. An electrical connector according to claim 1 wherein the area defining a cavity in said housing which functions as a flux trap is positioned between the slots and the plug inserting opening.

5. An electrical connector according to claim 1, wherein said terminal slots are V-shaped.

6. An electrical connector according to claim 5 wherein said V-shaped terminal slots are provided with two protrusions at their neck portions.

7. An electrical connector according to claim 1, further comprising:

a socket integrated in said housing.

8. An electrical connector according to claim 7, wherein said socket is a DC power socket.

9. A modular jack adapted to be mounted on a printed circuit board, comprising:

an insulative housing having upper, front, and bottom surfaces;

at least one plug inserting opening on said front surface of said housing for inserting a plug;

a plurality of electrically conductive contact pins each of which is held in one of a plurality of terminal slots provided in said bottom surface of said housing, a first contact part extending from the one of the plurality of terminal slots, and a second contact part projecting within said plug inserting opening, the housing, plug inserting opening and plurality of electrically conductive contact pins configured so that flux can wick from a first contact to a second contact of one of the plurality of contact pins when the first contact is soldered to the printed circuit board; and an area defining a cavity in said housing provided in a contact area between said housing and said contact pin wherein said cavity functions as a flux trap which prevents flux from wicking from a first contact to a second contact of one of the plurality of contact pins when the first contact is soldered to the printed circuit board.

10. A modular jack according to claim 9, wherein said terminal slots are V-shaped.

11. A modular jack according to claim 10, wherein said V-shaped terminal slots are provided with two protrusions at their neck portions.

12. An electrical connector comprising:

a housing formed of an electrically insulative material;

at least one electrically conductive contact extending in the housing, a portion of the contact being disposed in engagement with the housing, said housing engaging portion being adjacent a portion of the contact adapted to receive flux, the contact having a first portion and a second portion, and the housing configured so that flux can wick from the first portion to the second portion when the first portion is soldered; and a cavity formed in the housing, said cavity being located in the area of engagement of the contact with the housing, to function as a contact flux trap which prevents flux from wicking from the first portion to the second portion when the first portion is soldered.

13. An electrical connector according to claim 12 wherein the portion of the contact adapted to receive flux extends over the cavity.

14. A modular jack comprising:

a housing formed of an electrically insulative material;

at least one electrically conductive contact extending in the housing, a portion of the contact being disposed in engagement with the housing, said housing engaging portion being adjacent a portion of the contact adapted to receive flux, the contact having a first portion and a second portion, and the housing configured so that flux can wick from the first portion to the second portion when the first portion is soldered; and a cavity formed in the housing, said cavity being located in the area of engagement of the contact with the housing, to function as a contact flux trap which prevents flux from wicking from the first portion to the second portion when the first portion is soldered.

15. A modular jack according to claim 14 wherein the portion of the contact adapted to receive flux extends over the cavity.

* * * * *